US011498082B2

(12) United States Patent
Noffsinger

(10) Patent No.: US 11,498,082 B2
(45) Date of Patent: Nov. 15, 2022

(54) CENTRIFUGE SAFETY MECHANISM

(71) Applicant: Terumo BCT, Inc., Lakewood, CO (US)

(72) Inventor: Luke Ryan Noffsinger, Brighton, CO (US)

(73) Assignee: Terumo BCT, Inc., Lakewood, CO (US)

( * ) Notice: Subject to any disclaimer, the term of this patent is extended or adjusted under 35 U.S.C. 154(b) by 317 days.

(21) Appl. No.: 16/821,195

(22) Filed: Mar. 17, 2020

(65) Prior Publication Data

US 2020/0215554 A1 Jul. 9, 2020

Related U.S. Application Data

(62) Division of application No. 14/577,763, filed on Dec. 19, 2014, now Pat. No. 10,618,060.

(60) Provisional application No. 61/919,679, filed on Dec. 20, 2013.

(51) Int. Cl.

| | |
|---|---|
| ***B04B 7/06*** | (2006.01) |
| ***B04B 5/04*** | (2006.01) |
| ***B04B 7/00*** | (2006.01) |

(52) U.S. Cl.

CPC ..... *B04B 7/06* (2013.01); *B04B 5/0442* (2013.01); *B04B 7/00* (2013.01); *Y10T 29/49947* (2015.01); *Y10T 29/49966* (2015.01)

(58) Field of Classification Search

CPC ..... B04B 7/06; B04B 5/0442; B04B 7/00; Y10T 29/49947; Y10T 29/49966

USPC ..... 494/12; 29/525.01, 525.13; 422/562

See application file for complete search history.

(56) References Cited

U.S. PATENT DOCUMENTS

| | | | | |
|---|---|---|---|---|
| 3,987,961 | A | 11/1976 | Sinn et al. | |
| 4,127,231 | A * | 11/1978 | Khoja | B04B 5/0442 494/84 |
| 4,187,979 | A | 2/1980 | Cullis et al. | |
| 4,256,120 | A | 3/1981 | Finley | |
| 4,443,345 | A | 4/1984 | Wells | |
| 4,720,284 | A | 1/1988 | McCarty | |
| 4,939,087 | A | 7/1990 | Van Wie et al. | |
| 4,990,132 | A | 2/1991 | Unger et al. | |
| 5,039,401 | A | 8/1991 | Columbus et al. | |
| 5,405,308 | A | 4/1995 | Headley et al. | |
| 5,417,529 | A * | 5/1995 | Volkmann | F16B 19/1063 411/13 |
| 5,577,513 | A | 11/1996 | Van Vlasselaer | |
| 5,674,173 | A | 10/1997 | Hlavinka et al. | |
| 5,722,926 | A | 3/1998 | Hlavinka et al. | |
| 5,792,372 | A | 8/1998 | Brown et al. | |

(Continued)

FOREIGN PATENT DOCUMENTS

| | | |
|---|---|---|
| EP | 2815776 B1 | 2/2016 |
| EP | 2717942 B1 | 5/2016 |

(Continued)

*Primary Examiner* — Shuyi S. Liu

(74) *Attorney, Agent, or Firm* — Harness, Dickey & Pierce, P.L.C.

(57) ABSTRACT

Embodiments are directed to methods and apparatuses for ensuring that mechanisms that are used to position components of an apheresis machine are not broken as a result of rotation of a centrifuge. In embodiments, a safety mechanism is provided that contacts components of the centrifuge and pushes them into a position to ensure that they do not break when the centrifuge is operated at high rpm.

19 Claims, 7 Drawing Sheets

(56) References Cited

U.S. PATENT DOCUMENTS

| | | | |
|---|---|---|---|
| 5,858,251 | A | 1/1999 | Borchardt et al. |
| 5,906,570 | A | 5/1999 | Langley et al. |
| 5,913,768 | A | 6/1999 | Langley et al. |
| 5,939,319 | A | 8/1999 | Hlavinka et al. |
| 5,951,877 | A | 9/1999 | Langley et al. |
| 6,022,306 | A | 2/2000 | Dumont et al. |
| 6,053,856 | A | 4/2000 | Hlavinka |
| 6,071,422 | A | 6/2000 | Hlavinka et al. |
| 6,334,842 | B1 | 1/2002 | Hlavinka et al. |
| 6,352,499 | B1 | 3/2002 | Geigle |
| 6,354,986 | B1 | 3/2002 | Hlavinka et al. |
| 6,514,189 | B1 | 2/2003 | Hlavinka et al. |
| 6,574,173 | B1 | 6/2003 | Manes |
| 7,029,430 | B2 | 9/2006 | Hlavinka et al. |
| 7,201,848 | B2 | 4/2007 | Antwiler et al. |
| 7,549,956 | B2 | 6/2009 | Hlavinka et al. |
| 7,588,692 | B2 | 9/2009 | Antwiler et al. |
| 7,857,744 | B2 | 12/2010 | Langley et al. |
| 7,867,159 | B2 * | 1/2011 | Dolecek ..... B04B 13/00 210/512.1 |
| 7,963,901 | B2 | 6/2011 | Langley et al. |
| 8,226,537 | B2 | 6/2012 | Pittinger et al. |
| 9,156,039 | B2 | 10/2015 | Holmes et al. |
| 9,737,898 | B2 | 8/2017 | Holmes et al. |
| 2002/0032398 | A1 | 3/2002 | Steele et al. |
| 2006/0147895 | A1 | 7/2006 | Purdum |
| 2007/0102374 | A1 | 5/2007 | Kolenbrander |
| 2012/0234731 | A1 | 9/2012 | Senftleber |
| 2015/0375238 | A1 | 9/2015 | Holmes et al. |

FOREIGN PATENT DOCUMENTS

| | | | |
|---|---|---|---|
| WO | 87/06857 | A1 | 11/1987 |
| WO | 98/18403 | A1 | 5/1998 |
| WO | 2012128833 | A1 | 9/2012 |
| WO | 2012174007 | A1 | 12/2012 |

* cited by examiner

CENTRIFUGE SAFETY MECHANISM

CROSS-REFERENCE TO RELATED PATENT APPLICATION(S)

This patent application is a divisional application of and claims priority to, U.S. patent application Ser. No. 14/577,763, entitled "CENTRIFUGE SAFETY MECHANISM," filed on Dec. 19, 2014. U.S. patent application Ser. No. 14/577,763 claims priority to U.S. Provisional Patent Application No. 61/919,679, entitled CENTRIFUGE SAFETY MECHANISM, filed on Dec. 20, 2013, which is hereby incorporated by reference in its entirety as if set forth herein in full.

BACKGROUND

There are a number of processes that are used to separate a composite fluid into components. Some examples of composite fluids that are separated include biological fluids, which may include an aqueous component and one or more cellular components, e.g., whole blood. Separation of whole blood may occur as part of an apheresis procedure, which may be performed on apheresis machines. The machines remove whole blood from a donor, separate the blood, collect one or more blood components from the donor and return the other component(s) to the donor.

Some apheresis machines utilize centrifugal force to separate blood into components. These machines therefore include a centrifuge, which spins at relatively high rotations per minute (rpm). Accordingly, it is important that all components of the machine are safely positioned to avoid failure of any part of the machine when the centrifuge operates at high rpm. When the centrifuge is operating at high rpm any component that breaks may cause catastrophic failure of the machine if it strikes any portion of the centrifuge rotating at a high rpm.

Embodiments of the present invention have been made in light of these and other considerations. However, the relatively specific problems discussed above do not limit the applicability of the embodiments of the present invention to the specific problems.

SUMMARY

Embodiments are directed to methods and apparatuses for ensuring that mechanisms that are used to position components of an apheresis machine are not broken as a result of rotation of a centrifuge. In embodiments, a safety mechanism is provided that contacts components of the centrifuge and pushes them into a safe position to ensure that they do not break when the centrifuge is operated at high rpm. In one specific embodiment, a safety mechanism is provided on a tubing arm designed to hold tubing of a disposable component used in an apheresis machine. The disposable component may be held in place, at least in part by a latch arm. As the centrifuge begins rotating, the safety mechanism is designed to contact the latch arm and push it into a position, so that when the centrifuge spins at high rpm, the latch arm does not break and strike the centrifuge while it spins at high rpm.

This summary is provided to introduce aspects of some embodiments of the present invention in a simplified form, and is not intended to identify key or essential elements of the claimed invention, nor is it intended to limit the scope of the claims.

BRIEF DESCRIPTION OF THE DRAWINGS

Non-limiting and non-exhaustive embodiments are described with reference to the following figures.

DETAILED DESCRIPTION

The principles of the present invention may be further understood by reference to the following detailed description and the embodiments depicted in the accompanying drawings. It should be understood that although specific features are shown and described below with respect to detailed embodiments, the present invention is not limited to the embodiments described below.

Embodiments below may be described with respect to separating whole blood and blood components. However, this is done simply for illustrative purposes. It is noted that the embodiments are not limited to the description below. The embodiments are intended for use in products, processes, devices, and systems for separating any composite liquid. Accordingly, the present invention is not limited to machines or devices used in separation of whole blood or blood components.

Figure 1:
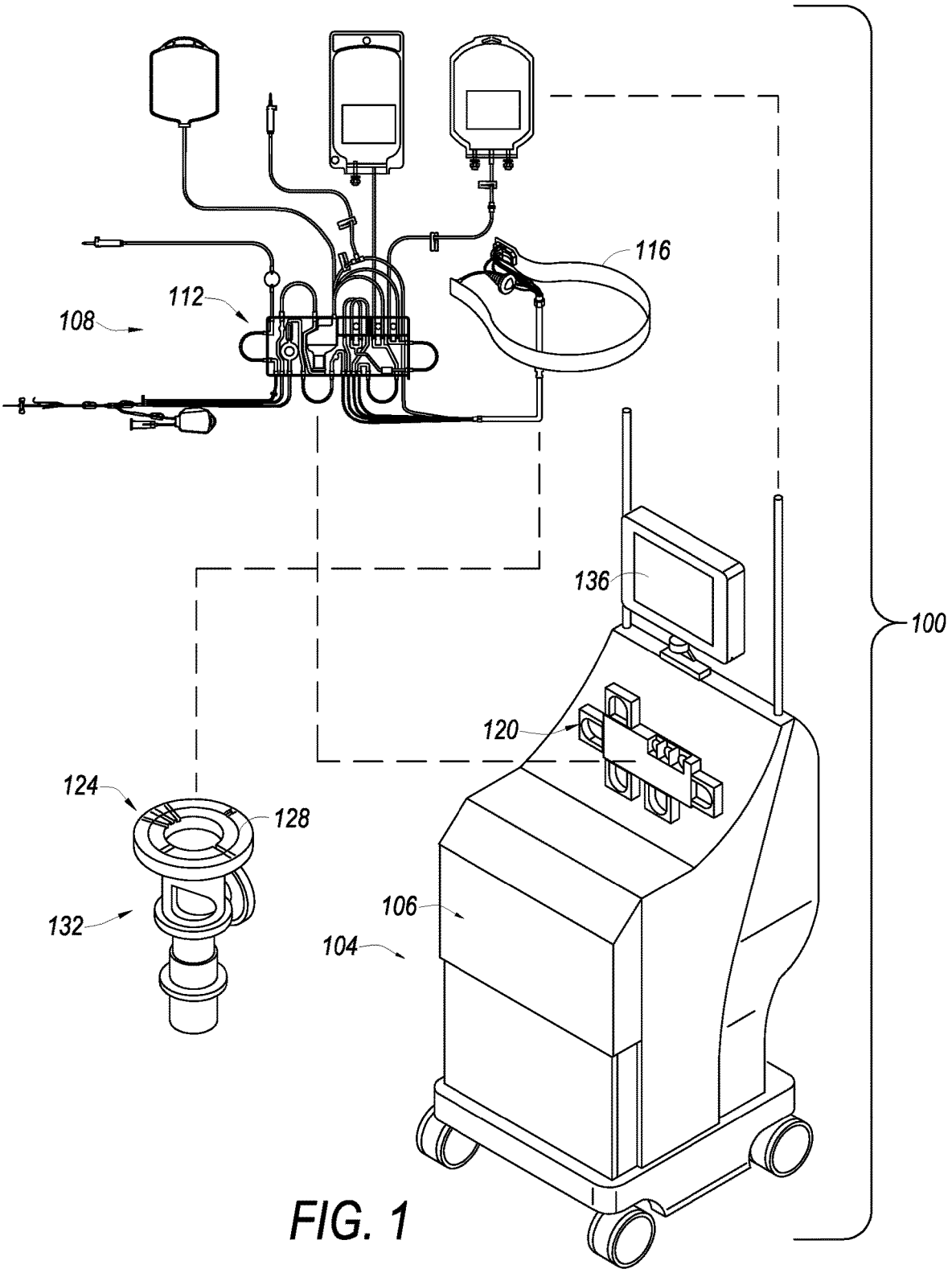
FIG. 1 illustrates an apheresis machine that may utilize mechanism(s) according to some embodiments.

FIG. 1 illustrates one embodiment of an apheresis system 100, which can be used in, or with, embodiments. In embodiments, apheresis system 100 provides for a continuous whole blood separation process, e.g., apheresis procedure including therapeutic procedures. In one embodiment, whole blood is withdrawn from a donor and is substantially continuously provided to a blood component separation device, e.g., apheresis machine 104 where the blood is separated into various components and at least one of these blood components is collected using the apheresis machine 104. One or more of the separated blood components may be either collected for subsequent use or returned to the donor. In embodiments, blood is withdrawn from the donor and directed through a bag and a disposable component, e.g., tubing set 108, which includes an extracorporeal tubing circuit 112, and a blood processing vessel 116, which together define a closed, sterile and disposable system. The set 108 is adapted to be mounted in the apheresis machine 104. The apheresis machine 104 includes a pump/valve/sensor assembly 120, which interfaces with the extracorporeal tubing circuit 112, and a centrifuge assembly 124, which interfaces with the blood processing vessel 116 and is located in an internal volume 106 of the apheresis machine 104.

Examples of systems that include apheresis machines (e.g., machine 104) and other separation devices that may be used with embodiments of the present invention, include the SPECTRA OPTIA® apheresis system, COBE® spectra apheresis system, and the TRIMA ACCEL® automated blood collection system, all manufactured by Terumo BCT, of Lakewood, Colo.

The centrifuge assembly 124 may include a channel 128 in a rotatable rotor assembly 132, which provides the centrifugal forces required to separate blood into its various blood component(s) by centrifugation. The blood processing vessel 116 may then be fitted within the channel 128. Blood can flow substantially continuously from the donor, through the extracorporeal tubing circuit 112, and into the rotating blood processing vessel 116. Within the blood processing vessel 116, blood may be separated into various blood component types and at least one of these blood component types (e.g., white blood cells, platelets, plasma, or red blood cells) may be removed from the blood processing vessel 116. Blood components that are not being retained for collection or for therapeutic treatment (e.g., platelets and/or plasma) are also removed from the blood processing vessel 116 and returned to the donor via the extracorporeal tubing circuit 112. Various alternative apheresis systems (not shown) may also make use of embodiments of the present invention, including batch processing systems (non-continuous inflow of whole blood and/or non-continuous outflow of separated blood components) or smaller scale batch or continuous RBC/plasma separation systems, whether or not blood components may be returned to the donor.

Operation of the apheresis machine 104 may be controlled by one or more processors included therein, and may advantageously comprise a plurality of embedded computer processors that are part of a computer system. The computer system may also include components that allow a user to interface with the computer system, including for example, memory and storage devices (RAM, ROM (e.g., CD-ROM, DVD), magnetic drives, optical drives, flash memory); communication/networking devices (e.g., wired such as modems/network cards, or wireless such as Wi-Fi); input devices such keyboard(s), touch screen(s), camera(s), and/or microphone(s); and output device(s) such as display(s), and audio system(s) a. In order to assist the operator of the apheresis system 100 with various aspects of its operation, the embodiment of the blood component separation device 104 (shown in FIG. 1) includes a graphical user interface 136 with a display that includes an interactive touch screen.

Figure 2B:
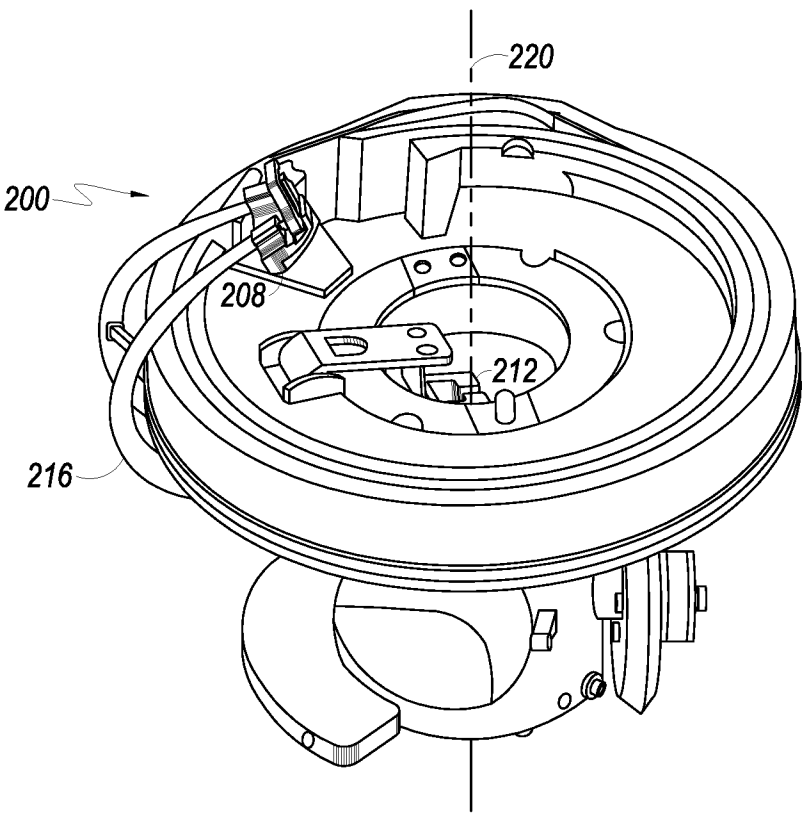
FIG. 2B illustrates a centrifuge that may be part of an apheresis machine and includes the latch arm of FIG. 2A in a second position.
Figure 2A:
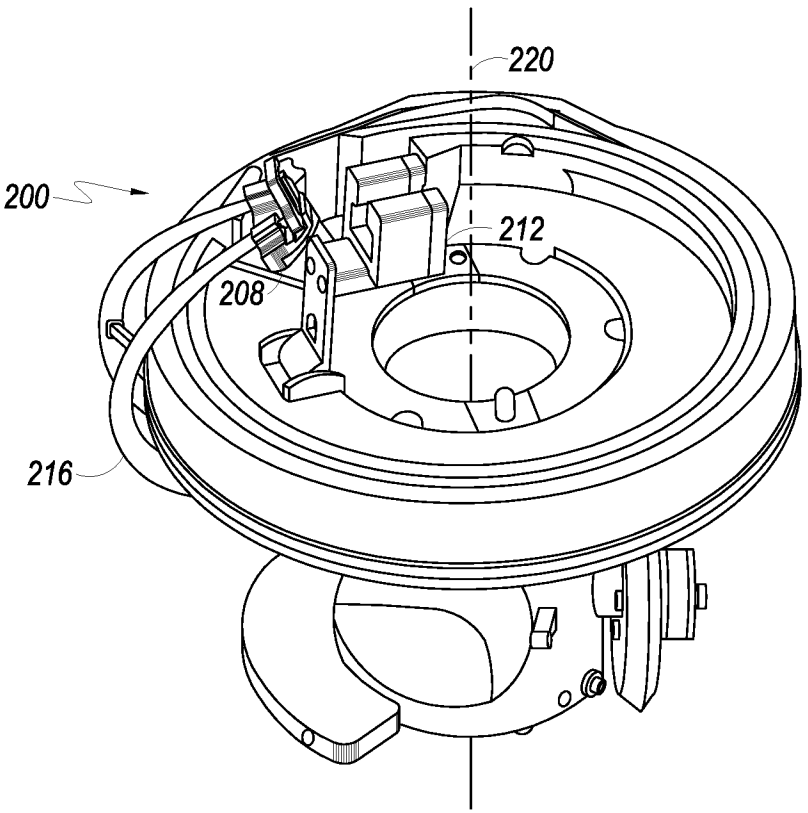
FIG. 2A illustrates a centrifuge that may be part of an apheresis machine and includes a latch arm in a first position.

FIGS. 2A and 2B illustrate an example of a centrifuge assembly 200 that may be part of an apheresis machine e.g., 104 (FIG. 1), and in embodiments may be housed within the internal volume of an apheresis machine, e.g., 106 (FIG. 1). Centrifuge assembly 200 may utilize some safety mechanism(s) 208 according to embodiments of the present invention. As described in greater detail below, the safety mechanism 208 may be used to move a latch arm 212 into a position that prevents it from breaking when the centrifuge 200 is spinning at high rpm. Axis 220 indicates the axis of rotation of the centrifuge assembly 200.

As illustrated by FIG. 2A, latch arm 212 is positioned in what may be referred to as an upward position. While in FIG. 2B, the latch arm 212 is positioned in what may be referred to as a downward position. When a disposable tubing set (e.g., tubing set 108 of FIG. 1) is placed in the centrifuge assembly 200, latch arm 212 is initially positioned in the upward position (FIG. 2A). After a tubing set has been loaded into the centrifuge assembly 200, the latch arm 212 is positioned in the downward position to maintain a portion of the disposable tubing set in a predetermined position or alignment. In embodiments, the portion may be part of the separation vessel, tubing, a separation chamber, or other portions of the disposable tubing set. When centrifuge assembly 200 does not have the second portion of disposable tubing set 108, the latch arm 212 may be free to move from the upward position (as shown in FIG. 2A) to the downward position (as shown in FIG. 2B). As discussed below, a problem may arise when latch arm 212 is in an upward position and the centrifuge 200 starts to spin.

If the apheresis machine 104 is activated and centrifuge assembly 200 spins with latch arm 212 in the upward position, it will break and the pieces may damage other components of the apheresis machine 104. Consistent with some embodiments, centrifuge assembly 200 may utilize safety mechanism 208 that may be designed to contact latch arm 212 when centrifuge 200 starts to spin and latch arm 212 is in the upward position. As a result of contacting safety mechanism 208, latch arm 212 will move into the downward position (FIG. 2B). Accordingly, when centrifuge 200 reaches a higher rpm the latch arm 212 will be in the downward position and will not break off. In the embodiment shown in FIGS. 2A and 2B, safety mechanism 208 is attached to a tubing arm 216. The tubing arm 216 may used to hold tubing of disposable set (e.g., 108).

Figure 3:
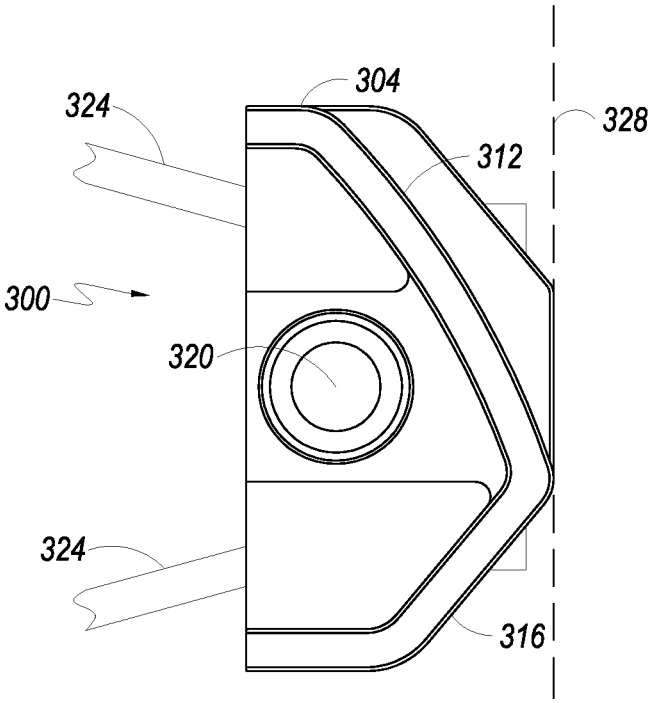
FIG. 3 illustrates a bottom view of a safety mechanism according to an embodiment.
Figure 4:
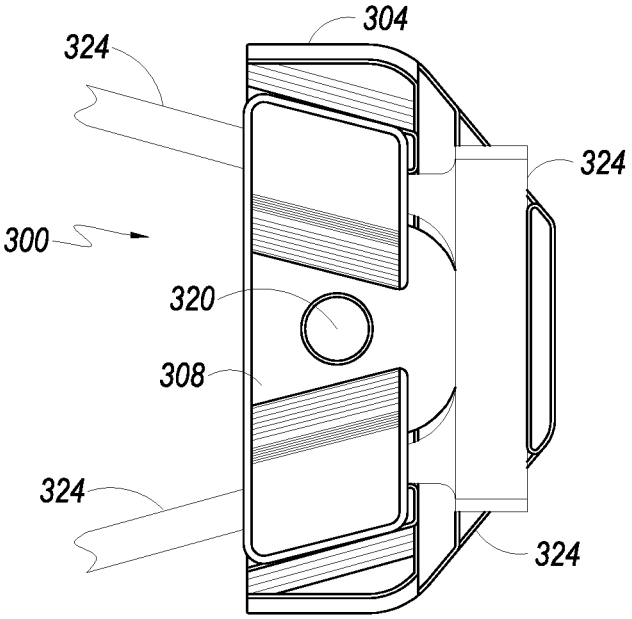
FIG. 4 illustrates a top view of the safety mechanism illustrated in FIG. 3.
Figure 5:
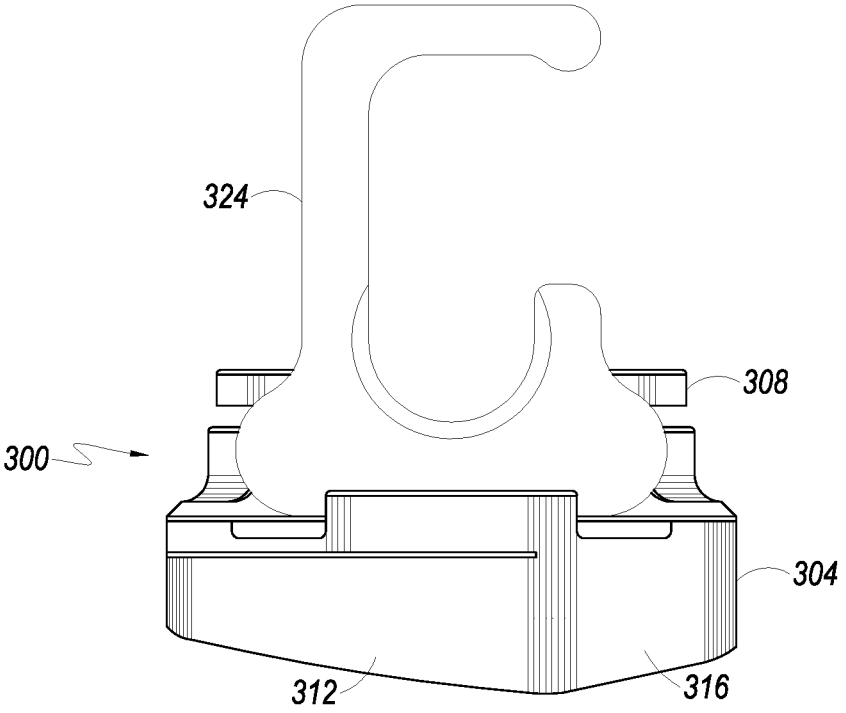
FIG. 5 illustrates a front view of the safety mechanism illustrated in FIG. 3.
Figure 6:
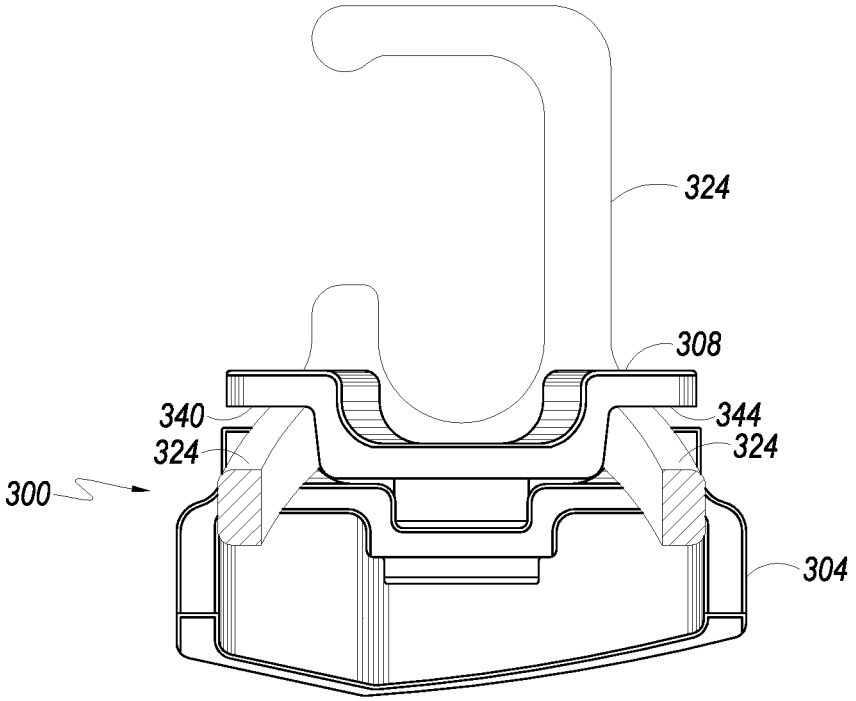
FIG. 6 illustrates a back view of the safety mechanism illustrated in FIG. 3.
Figure 7:
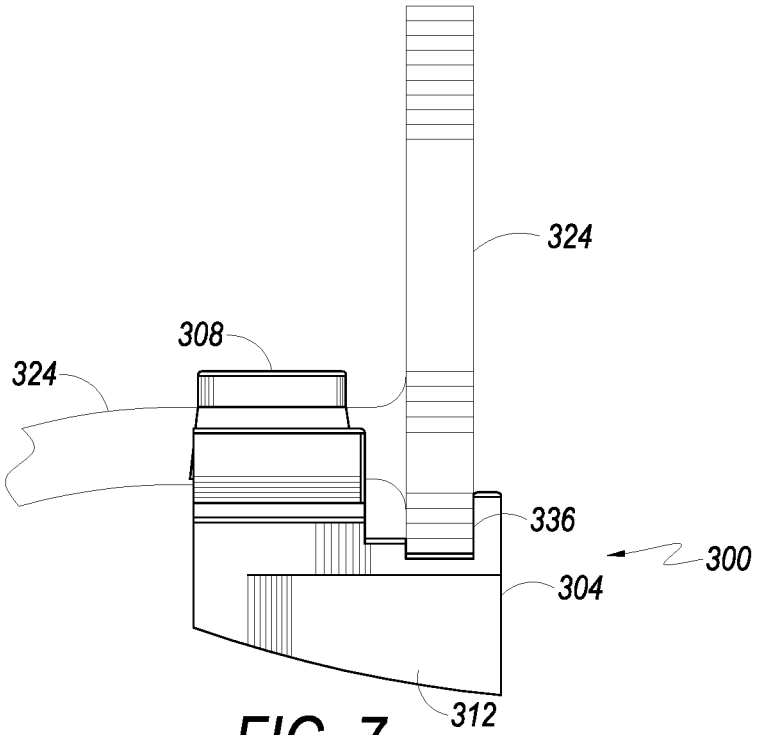
FIG. 7 illustrates a side view of the safety mechanism illustrated in FIG. 3.
Figure 8:
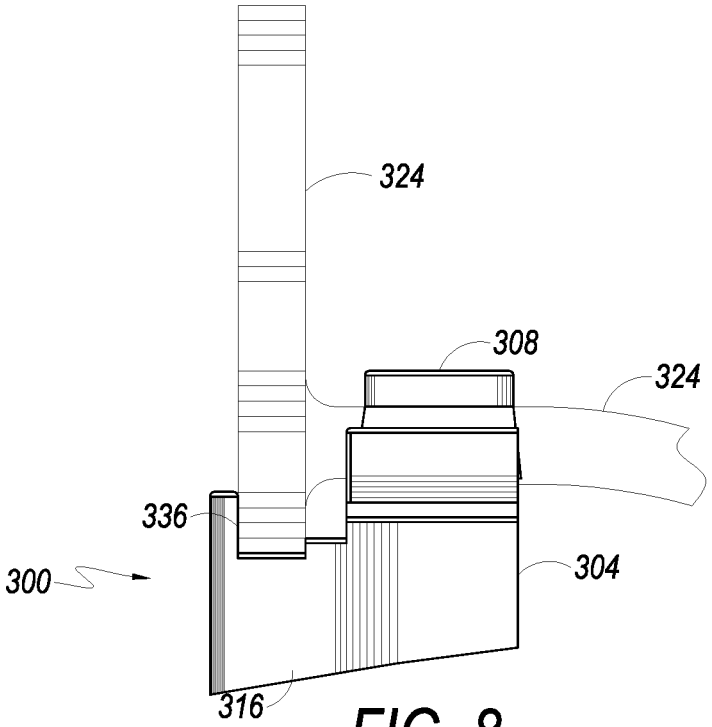
FIG. 8 illustrates another side view of the safety mechanism illustrated in FIG. 3.
Figure 9:
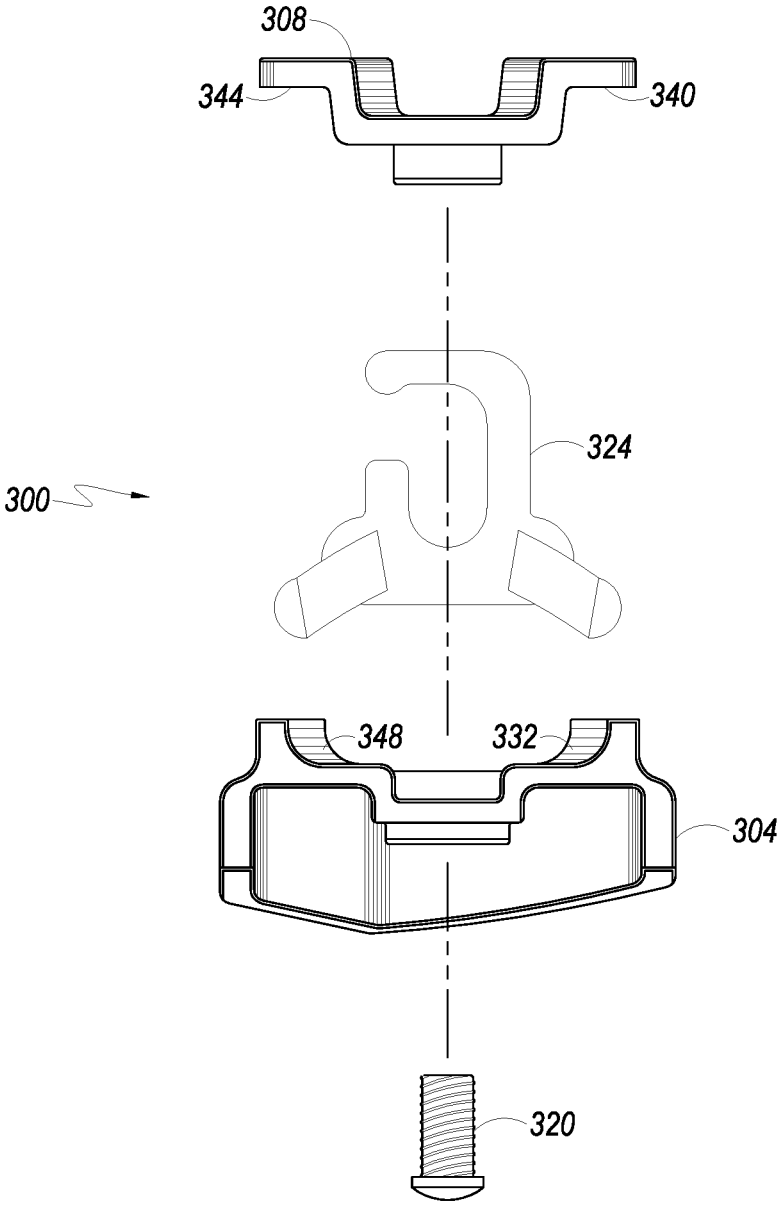
FIG. 9 illustrates an exploded view of the safety mechanism illustrated in FIG. 3.

FIGS. 3-9 illustrate a safety mechanism 300 according to one embodiment. FIG. 3 illustrates a bottom view of safety mechanism 300. FIG. 4 illustrates a top view of safety mechanism 300. FIG. 5 illustrates a front view of safety mechanism 300. FIG. 6 illustrates a back view of safety mechanism 300. FIG. 7 illustrates a side view of safety mechanism 300. FIG. 8 illustrates another side view of safety mechanism 300. FIG. 9 illustrates an exploded view of the safety mechanism 300. As illustrated in FIGS. 3-9, safety mechanism 300 may be attached to a portion of a tubing arm 324, e.g., an end of tubing arm 324. It is noted that for purposes of simplicity, only a portion of tubing arm 324 is shown in FIGS. 3-9, namely an end of the tubing arm 324.

As illustrated in FIGS. 3-9, safety mechanism 300 includes a first portion 304 and a second portion 308. The first portion 304 and second portion 308 may be connected using a fastener 320. In embodiments, fastener 320 is a screw with threads that engage with threads on one or more of first portion 304 and second portion 308. In some embodiments, safety mechanism 300 is attached to tubing arm 324 by positioning a portion of tubing arm 324 between first portion 304 and second portion 308 and tightening fastener 320 to secure mechanism 300 onto the tubing arm 324, e.g., an end of tubing arm 324.

In some embodiments, portion 304 and portion 308 include a feature(s) that are designed to engage with features of arm 324. For example, first portion 304 includes a first channel 332, a second channel 348, and a third channel 336 where a first portion, second portion, and third portion of tubing arm 324 may be positioned to secure the first portion 304 to tubing arm 324. Similarly, second portion 308 includes a first channel 340 and a second channel 344 where a third portion and fourth portion of tubing arm 324 may be positioned to secure second portion 308 to the tubing arm 324.

First portion 304 in embodiments includes a first angled surface 312 and a second angled surface 316. The angled surfaces 312 and 316 in embodiments are the portion of mechanism 300 that may contact a latch arm, for example latch arm 212 (FIG. 2). As can be appreciated, the angled surfaces 312 and 316 are designed to guide a latch arm from a first position, e.g., an upward position, toward a second position, e.g., a downward position. In embodiments, the surfaces 312 and 316 may cause the latch arm to move enough so that it gains enough momentum to move to the second position where it may stay. In embodiments, the first angled surface 312 and the second angled surface 316 are positioned so that they face an axis of rotation of a centrifuge. For example, in FIGS. 2A and 2B safety mechanism 208 is shown with a first angled surface (e.g. 312) and a second angled surface (e.g. 316) facing axis 220.

As illustrated in FIGS. 3-9, in embodiments, the first surface 312 and second surface 316 may have different angles and different lengths. For example, the first surface 312 may have a shallower angle, e.g., a larger angle with respect to line 328. The second surface 316 may have a sharper angle, e.g., a smaller angle with respect to line 328. In the embodiments, shown, surface 312 is longer than surface 316.

It is noted that the present invention is not limited to the embodiment described in FIGS. 3-9. In other embodiments, the angled surfaces 312 and 316 may have the same angle and lengths, different angles and the same length, or the same angles and different lengths.

It is noted that is some embodiments, angled surfaces 312 and 316 may include, or be made of, materials that provide low friction so that if they contact a latch arm, the latch arm may travel smoothly across the surface. For example, the angled surfaces 312 and 308 may be made of materials that include, or have a coating of, one or more of: polytetrafluoroethylene, polyoxymethylene, polyetheretherketone, polyethylene, Ultra-high molecular weight polyethylene, polyamide, or polycarbonate. In some embodiments, first portion 304 and/or second portion 308 may be molded or machined from the same material, which may be a low friction material, such as one or more of the materials mentioned above. In other embodiments, a low friction material may be added (as a coating or layer) to one or more of the angled surfaces 312 and 316.

It is also noted that fastener 320 may be positioned, and its threads designed, to be self tightening when arm 324 is spinning with the centrifuge. For example, in embodiments, the fastener 320 is positioned so that any coriolis effect experienced by the fastener serves to tighten the fastener. In this embodiment, the head of fastener 320 may face an axis of rotation, e.g., axis 220 (FIG. 2) and be threaded so that rotation of the centrifuge will tend to cause the fastener to tighten.

Additionally, in some embodiments, additional features may be provided to secure fastener 320 to one or more of first portion 304, second portion 308, or tubing arm 324. For example, in some embodiments, an adhesive material may be places over the head of fastener 320 after it has been used to connect first portion 304 and second portion 308. The adhesive will further attach or adhere fastener 320 to first portion 304.

Figure 10:
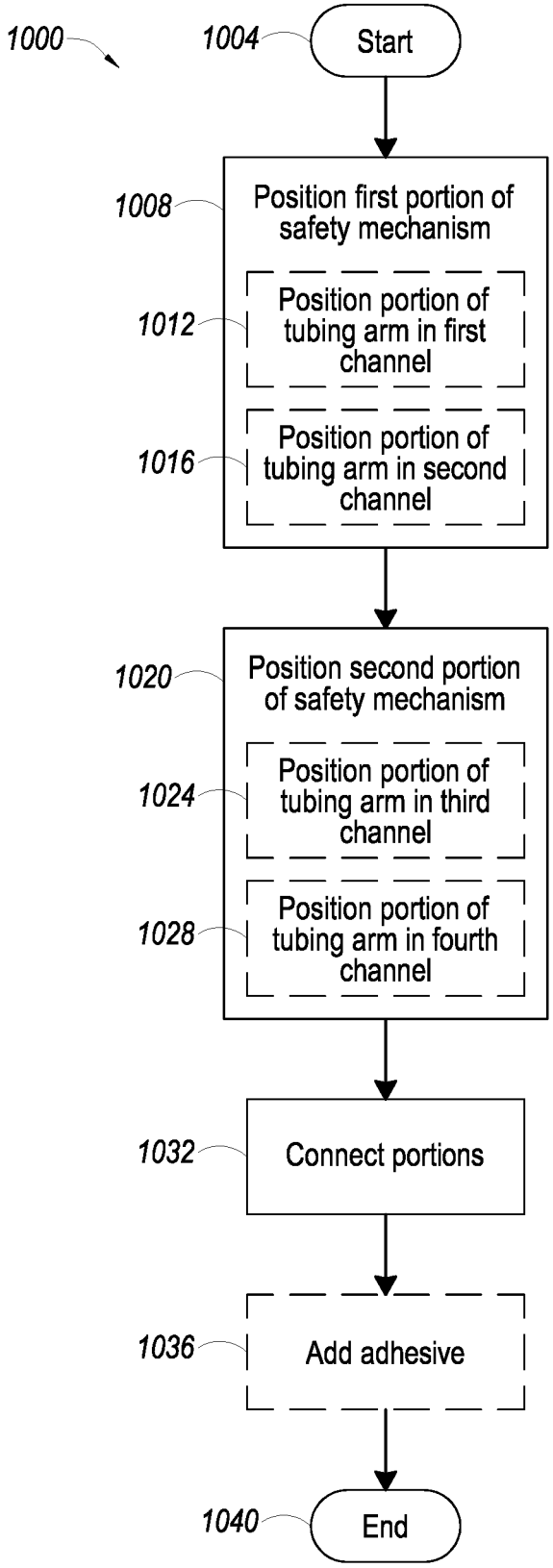
FIG. 10 illustrates a process for preventing failure of a centrifuge assembly.

FIG. 10 illustrates flow chart 1000 which may be performed in embodiments of the present invention. Although specific components may be described below for performing steps in flow chart 1000, the present invention is not limited thereto. This is done merely for illustrative purposes, because flow chart 1000 is not limited to being performed by or with any specific components, structures, or combinations thereof.

Flow 1000 starts at 1004 and passes to step 1008 where a first portion of a safety mechanism is positioned. In one embodiment, the first portion, such as first portion 304, may be positioned on an end of a tubing arm, e.g., tubing arm 324. In embodiments, step 1008 may involve a number of sub-steps. For example, at sub-step 1012, a portion of a tubing arm may be positioned in a first channel in the first portion of the safety mechanism. For example, a portion of tubing arm 324 may be positioned in first channel 332. A second optional step 1016 may be performed to position another portion of tubing arm 324 in a second channel, such as channel 348. In other embodiments, step 1008 may include additional steps not shown in flow 1000. For example, a third portion of the tubing arm may be placed in another, third channel (e.g., channel 336), of the first portion of the safety mechanism. This is merely an example and other sub-steps may be performed in other embodiments.

Following step 1008, a second portion of the safety mechanism may be positioned at step 1020. In embodiments, the second portion is also positioned on an end of a tubing arm. Similar to step 1008, step 1020 may involve a number of sub-steps. At sub-step 1024, a portion of a tubing arm may be positioned in a fourth channel in the second portion of the safety mechanism. For example, a portion of tubing arm 324 may be positioned in channel 340. At optional step 1028 another portion of tubing arm 324 may be positioned in a fifth channel, such as channel 340.

Flow passes from step 1020 to step 1032 where the first portion and the second portion of the safety mechanism are connected. In embodiments, the portions may be connected by a fastener (e.g., fastener 320). The fastener may be any appropriate fastener for connecting the portions together, some non-limiting examples including bolts, nuts, screws, washers, brackets, hooks, pins, nails, rivets, spacers, rings, stables, etc. In one embodiment, the fastener may be a threaded screw or bolt that engages threads on one or more of first portion and second portion of the safety mechanism.

After step 1032, an optional step 1036 may be performed to add an adhesive to the fastener to adhere it to one or more of first portion and second portion of the safety mechanism. The adhesive may be any appropriate type of adhesive for connecting a fastener to another part. A thread-locking adhesive is one example of an adhesive that may be used, which may be used before or during step 1032. Flow 1000 ends at 1040.

With respect to the flow chart illustrated in FIG. 10, the operational steps depicted are offered for purposes of illustration and may be rearranged, combined into other steps, used in parallel with other steps, etc., according to embodiments of the present disclosure. Fewer or additional steps may be used in embodiments without departing from the spirit and scope of the present disclosure. Also, the steps (and any sub-steps) may be performed automatically in some embodiments and manually in others.

It will be apparent to those skilled in the art that various modifications and variations can be made to the methods and structure of the present invention without departing from its scope. Thus it should be understood that the invention is not limited to the specific examples given. Rather, the invention is intended to cover modifications and variations within the scope of the following claims and their equivalents. The steps, features, structures, and/or media are disclosed as illustrative embodiments for implementation of the claims and are not intended to limit the claims.

While example embodiments and applications of the present invention have been illustrated and described, it is to be understood that the invention is not limited to the precise configuration and resources described above. Various modifications, changes, and variations apparent to those skilled in the art may be made in the arrangement, operation, and details of the method(s) and apparatus of the present invention disclosed herein without departing from the scope of the claimed invention.

What is claimed is:

1. A centrifuge assembly for separating composite liquids, the centrifuge assembly comprising:

a latch arm configured to hold a portion of a disposable in place;

a tubing arm configured to hold tubing of the disposable; and a safety mechanism connected to the tubing arm, the safety mechanism comprising:

a first portion, comprising:

a first surface; and a second surface; and a second portion connected to the first portion;

wherein the first surface, the second surface, or both the first surface and the second surface are configured to contact the latch arm to move the latch arm from a first upward position to a second downward position.

2. The centrifuge assembly of claim 1, wherein at least a portion of the tubing arm is positioned between the first portion and the second portion of the safety mechanism.

3. The centrifuge assembly of claim 2, wherein the first portion further comprises a first channel for positioning the portion of the tubing arm.

4. The centrifuge assembly of claim 3, wherein the first portion further comprises a second channel for positioning a second portion of the tubing arm.

5. The centrifuge assembly of claim 4, wherein the second portion further comprises a channel for positioning a third portion of the tubing arm.

6. The centrifuge assembly of claim 5, further comprising a fastener for connecting the first portion to the second portion.

7. The centrifuge assembly of claim 6, wherein the fastener is threaded.

8. The centrifuge assembly of claim 7, wherein the fastener is positioned so that when the centrifuge assembly rotates, a force is applied to the fastener in a direction of tightening the fastener.

9. The centrifuge assembly of claim 8, wherein the safety mechanism is connected to an end of the tubing arm.

10. The centrifuge assembly of claim 9, wherein at least a portion of the safety mechanism extends beyond the end of the tubing arm.

11. The centrifuge assembly of claim 10, wherein the first surface and the second surface face an axis of rotation of the centrifuge assembly.

12. A method of preventing failure of a centrifuge assembly used to separate composite liquids, the method comprising:

positioning a first portion of a safety mechanism on an end of a tubing arm, wherein the first portion comprises a first surface and a second surface;

positioning a second portion of the safety mechanism on the end of the tubing arm;

connecting the first portion and the second portion with a fastener; and positioning the safety mechanism such that the first surface, the second surface, or both the first surface and the second surface are configured to contact a latch arm to move the latch arm from a first upward position to a second downward position, the latch arm configured to hold a portion of a disposable in place.

13. The method of claim 12, after the connecting, placing an adhesive on a head of the fastener to adhere the fastener to the first portion.

14. The method of claim 13, wherein the first portion comprises a first channel for positioning a portion of the tubing arm, and the positioning the first portion comprises:

positioning the portion of the tubing arm in the first channel.

15. The method of claim 14, wherein the second portion comprises a second channel for positioning a second portion of the tubing arm, and further comprising:

positioning a second portion of the tubing arm in the second channel.

16. The centrifuge assembly of claim 1, wherein the centrifuge assembly is configured to spin about an axis of rotation, the first surface forms a first angle with respect to a line perpendicular to the axis of rotation, and the second surface forms a second angle with respect to the line.

17. The centrifuge assembly of claim 16, wherein the first angle and the second angle are different from each other.

18. The centrifuge assembly of claim 1, wherein the first surface defines a first length, the second surface defines a second length, and the first length is different from the second length.

19. The centrifuge assembly of claim 1, wherein the first surface and the second surface each include a material selected from the group consisting of polytetrafluoroethylene, polyoxymethylene, polyetheretherketone, polyethylene, ultra-high molecular weight polyethylene, polyamide, polycarbonate, or a combination thereof.

* * * * *